US009195186B2

(12) United States Patent
Yamamoto

(10) Patent No.: US 9,195,186 B2
(45) Date of Patent: Nov. 24, 2015

(54) IMAGE HEATING APPARATUS HAVING AN EXCITATION COIL CONFIGURED TO GENERATE A MAGNETIC FLUX FOR ELECTROMAGNETIC INDUCTION HEATING OF A ROTATABLE HEATING MEMBER

(71) Applicant: CANON KABUSHIKI KAISHA, Tokyo (JP)

(72) Inventor: Naoyuki Yamamoto, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/221,487

(22) Filed: Mar. 21, 2014

(65) Prior Publication Data

US 2014/0286663 A1 Sep. 25, 2014

(30) Foreign Application Priority Data

Mar. 22, 2013 (JP) ..... 2013-059711

(51) Int. Cl.
*G03G 15/20* (2006.01)

(52) U.S. Cl.
CPC ..... *G03G 15/2042* (2013.01); *G03G 15/2025* (2013.01)

(58) Field of Classification Search
CPC ..... G03G 15/2042
USPC ..... 399/67, 68, 69, 320, 328, 329, 330
See application file for complete search history.

(56) References Cited

U.S. PATENT DOCUMENTS 7,196,296 B2 3/2007 Yamamoto
7,205,514 B2 4/2007 Suzuki et al.
7,238,924 B2 7/2007 Kondo et al.
7,268,326 B2 9/2007 Yamamoto et al.
7,268,327 B2 9/2007 Yamamoto et al.
7,835,680 B2 * 11/2010 Nanjo et al. ..... 399/329
8,099,008 B2 1/2012 Nakase et al.
8,358,949 B2 1/2013 Nakase et al.
8,606,160 B2 12/2013 Nakase et al.

(Continued)

FOREIGN PATENT DOCUMENTS

JP 59-33787 S 2/1984
JP 2000-39797 A 2/2000

OTHER PUBLICATIONS

English-language translation of JP 59-33787 dated Feb. 23, 1984.

*Primary Examiner* — Sandra Brase
(74) *Attorney, Agent, or Firm* — Fitzpatrick, Cella, Harper & Scinto

(57) ABSTRACT

An image heating apparatus includes: a rotatable heating member of magnetism-adjusted alloy configured to heat a toner image on a sheet; an excitation coil configured to generate a magnetic flux for electromagnetic induction heating of the rotatable heating member; a voltage source configured to supply an AC current to the excitation coil; a rotating mechanism configured to rotate the rotatable heating member at a first peripheral speed in an operation in a first image heating mode and configured to rotate the rotatable heating member at a second peripheral speed lower than the first peripheral speed in an operation in a second image heating mode; and a controller configured to control the voltage source in which the maximum current supplied to the excitation coil in the second image heating mode is smaller than the maximum current supplied to the excitation coil in the first image heating mode.

8 Claims, 7 Drawing Sheets

(56) References Cited

U.S. PATENT DOCUMENTS

2009/0257766 A1* 10/2009 Takada ..... 399/67
2011/0091230 A1 4/2011 Yamamoto
2012/0328338 A1 12/2012 Nawa et al.
2012/0328342 A1 12/2012 Takematsu et al.
2013/0094887 A1 4/2013 Nawa et al.
2014/0029992 A1 1/2014 Yamamoto

* cited by examiner

IMAGE HEATING APPARATUS HAVING AN EXCITATION COIL CONFIGURED TO GENERATE A MAGNETIC FLUX FOR ELECTROMAGNETIC INDUCTION HEATING OF A ROTATABLE HEATING MEMBER

FIELD OF THE INVENTION AND RELATED ART

The present invention relates to an image heating apparatus for heating a toner image on a sheet of recording medium.

In recent years, it has come to be emphasized to reduce an image forming apparatus in energy consumption, and also, to improve an image forming apparatus in operability (ability to quickly start up; shorter in warm-up time). Thus, a heating apparatus (which hereafter may be referred to simply as inductive heating apparatus (device)) which uses an inductive heating method, which is high in heat generation efficiency, has been proposed as an image heating apparatus to be employed as an image fixing apparatus for an image forming apparatus (Japanese Laid-open Patent Application S59-33787).

An inductive heating apparatus such as the above described one induces electrical current (eddy current) in its fixation roller (rotational heating member), so that heat (Joule heat) is generated by the interaction between the eddy current and the skin resistance of the fixation roller itself). This type of inductive heating apparatus is extremely high in heat generation efficiency, being therefore very short in the length of time it requires to warm up.

In a case where a substantial number of sheets of recording medium are continuously conveyed through a fixing apparatus (device) to process (fix) the images on the sheets, the portions of the fixation roller of the fixing apparatus, which are outside the path of the sheets of recording medium, become higher in temperature than the portion of the fixation roller, which is in the path of the sheets of recording medium. This phenomenon will be referred to as "unwanted out-of-sheet-path temperature increase", hereafter.

In a case where a sheet of recording medium, which is relatively large in size, is conveyed through a fixing apparatus to fix the image on the sheet immediately after the difference in temperature between the sheet-path portion and out-of-sheet-path portions of the fixation roller has become substantial due to the conveyance of a substantial number of sheets of recording medium of a relatively small size, it is possible that the image on the sheet of recording medium which is relatively large in size will be unsatisfactorily fixed.

Thus, it has been proposed to use a magnetic shunt alloy as the material for a fixation roller (Japanese Laid-open Patent Application 2000-39797). Generally speaking, as the temperature of a magnetic substance exceeds its Curie temperature, which is peculiar to the magnetic substance, it loses it self-magnetization properties, and therefore, it reduces in permeability. Consequently, it reduces in the density of the eddy current induced therein, which in turn reduces it in the amount by which heat is generated therein. Therefore, using a magnetic shunt alloy which is preset in its Curie temperature, as the material for a fixation roller, makes it possible to prevent the temperature of the out-of-sheet-path portions of the fixation roller from exceeding the saturation level. In other words, it can improve a fixing apparatus (fixing device) in terms of the phenomenon that the out-of-sheet-path portions of a fixation roller becomes excessively higher in temperature than the sheet-path portion of the fixation roller.

Also in recent years, demand has been increasing for image forming apparatuses which are capable of outputting an image on a sheet of such recording medium as cardstock, coated paper, and the like, to obtain various images different in properties. Cardstock is greater in thermal capacity than normal recording paper (ordinary paper), and therefore, requires a greater amount of heat to fix the toner image thereon. As for coated paper, its surface is flatter than the surface of normal recording paper. Therefore, it is greater that normal recording paper, in terms of the amount by which it reduces a fixation roller in temperature than ordinary recording paper. Hereafter, the mode in which an image on ordinary recording paper is fixed will be referred to as "normal paper mode", whereas the mode in which an image on cardstock is fixed will be referred to as "cardstock mode", which is made slower in fixation speed than the normal paper mode.

In has been known that in the case of a fixing apparatus (device), the material for the fixation roller of which is a magnetic shunt alloy, the temperature of the out-of-sheet-path portion of the fixation roller becomes stable at the saturation level, that is, the level at which the amount by which heat is generated in the out-of-sheet-path portion of the fixation roller when the temperature of the fixation roller is near the Curie temperature, becomes equal to the amount by which heat is radiated from the out-of-sheet-path portion.

The amount by which heat radiates from an object which is moving through the atmosphere is a function among the surface area of the object, relative speed between the atmosphere and object, and difference in temperature between the atmosphere and object. As for the amount by which heat radiates from the out-of-sheet-path portion of a fixation roller in the cardstock mode, it is smaller than the amount by which heat radiates from the out-of-sheet-path portions of the fixation roller in the normal paper mode.

Therefore, the temperature of the out-of-sheet-path portions of the fixation roller becomes higher in the cardstock mode, which is slower in recording medium conveyance speed than in the normal paper mode. Therefore, even in the case of a fixing apparatus (device), the material for the fixation roller of which is a magnetic shunt alloy, as a sheet of ordinary recording paper of a relatively large size is conveyed through the fixing apparatus to process (fix) the image thereon immediately after a substantial number of sheets of cardstock of a relatively small size have just been continuously conveyed through the fixing device to fix the image thereon, it is possible that the image on the sheet of ordinary recording paper of the relatively large size will be unsatisfactorily fixed.

SUMMARY OF THE INVENTION

According to an aspect of the present invention, there is provided an image heating apparatus comprising a rotatable heating member of magnetism-adjusted alloy configured to heat a toner image on a sheet; an excitation coil configured to generate a magnetic flux for electromagnetic induction heating of said rotatable heating member; a voltage source configured to supply an AC current to said excitation coil; a rotating mechanism configured to rotate said rotatable heating member at a first peripheral speed in an operation in a first image heating mode and configured to rotate said rotatable heating member at a second peripheral speed lower than the first peripheral speed in an operation in a second image heating mode; and a controller configured to control said voltage source in which a maximum current supplied to said excitation coil in the second image heating mode is smaller than a maximum current supplied to said excitation coil in the first image heating mode.

Further features of the present invention will become apparent from the following description of exemplary embodiments (with reference to the attached drawings).

DESCRIPTION OF THE PREFERRED EMBODIMENTS

Hereinafter, embodiments of the present invention are described with reference to appended drawings.

Embodiment 1

(1) Example of Image Forming Apparatus

Figure 1:
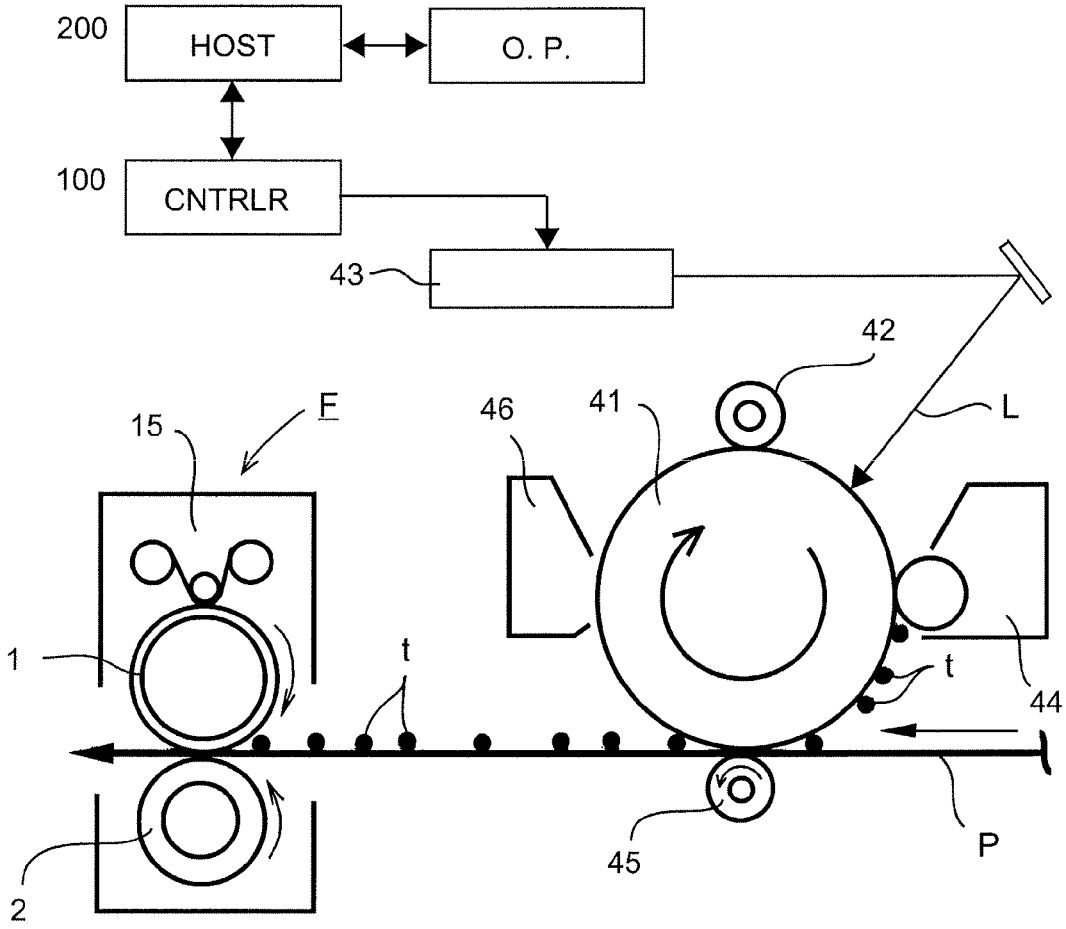
FIG. 1 is a schematic sectional view of an image forming apparatus in the first embodiment of the present invention, which shows the general structure of the apparatus.

FIG. 1 is a schematic sectional view of a typical image forming apparatus equipped with a heating device, as a thermal fixing device, which is in accordance with the present invention and generates heat by electromagnetic induction. It shows the general structure of the image forming apparatus. The image forming apparatus in this embodiment is an electrophotographic digital image forming apparatus (copying machine, printer, facsimile, multifunction image forming apparatus capable of performing functions of two or more of preceding image forming apparatuses) of the so-called transfer type. It employs a laser-based exposing (scanning) method.

Designated by a numeral 41 is a rotational photosensitive member (which hereafter will be referred to simply as drum) which is in the form of a drum, which is rotationally driven in the clockwise direction indicated by an arrow mark at a preset peripheral velocity. As the drum 41 is rotated, it is uniformly and negatively charged to a preset potential level Vd (pre-exposure potential level) by a primary charging device 42.

Designated by a numeral 43 is a laser beam scanner, which scans (exposes) the uniformly charged portion of the peripheral surface of the drum 41, with a beam L of laser light which it outputs while modulating the beam L with the digital image formation signals inputted into the exposing device 43 from a host apparatus 200 (FIG. 3) such as an image reading apparatus, a word processor, a computer, or the like. As a given point of the uniformly charged portion of the peripheral surface of the drum 41 is exposed, the given point reduces in potential (in terms of absolute value) to a potential level V1 (post-exposure level). Consequently, an electrostatic latent image, which reflects the image formation signals, is effected on the peripheral surface of the drum 41. This electrostatic latent image is developed into a visible image t, that is, an image t formed of toner, by a developing device 44, which adheres negatively charged toner to exposed points (which are V1 in potential level) of the peripheral surface of the drum 43.

Meanwhile, a sheet P of recording medium (which is to be heated and may hereafter be referred to as sheet of recording paper) is fed into the main assembly of the image forming apparatus from the sheet feeding portion (unshown) of the image forming apparatus. Then, the sheet P is introduced into the area of compression (transfer portion), that is, area of contact between the drum 41, and a transfer roller 45, as a transferring member, to which transfer bias is applied, with a proper timing, that is, in synchronism with the rotation of the drum 41. Thus, the toner image t on the peripheral surface of the drum 41 is transferred onto the surface of the sheet P as if it is peeled away from the peripheral surface of the drum 41. After the transfer of the toner image t onto the sheet P, the sheet P is separated from the drum 41, and is introduced into the fixing device F, which fixes the toner image t (unfixed image) on the sheet P to the sheet P by the application of pressure and heat to the sheet P, and the unfixed toner image t on the sheet P.

Thereafter, the sheet P is conveyed out of the fixing device F, and is discharged, as a finished print, from the main assembly of the image forming apparatus. After the separation of the sheet P of recording medium from the peripheral surface of the drum 41, the peripheral surface of the drum 41 is cleaned by a cleaner 46; the residues such as toner particles, and the like, remaining on the peripheral surface of the drum 41, are removed so that the drum 41 can be repeatedly used for image formation. The above described portion of the image forming apparatus, through which a sheet P of recording medium is conveyed before it arrives at the fixing device F, is the image forming portion of the image forming apparatus, which forms an unfixed image on a sheet P of recording medium while the sheet P is conveyed through this portion of the apparatus.

(2) Fixing Device F (2-1) General Structure

Figure 2:
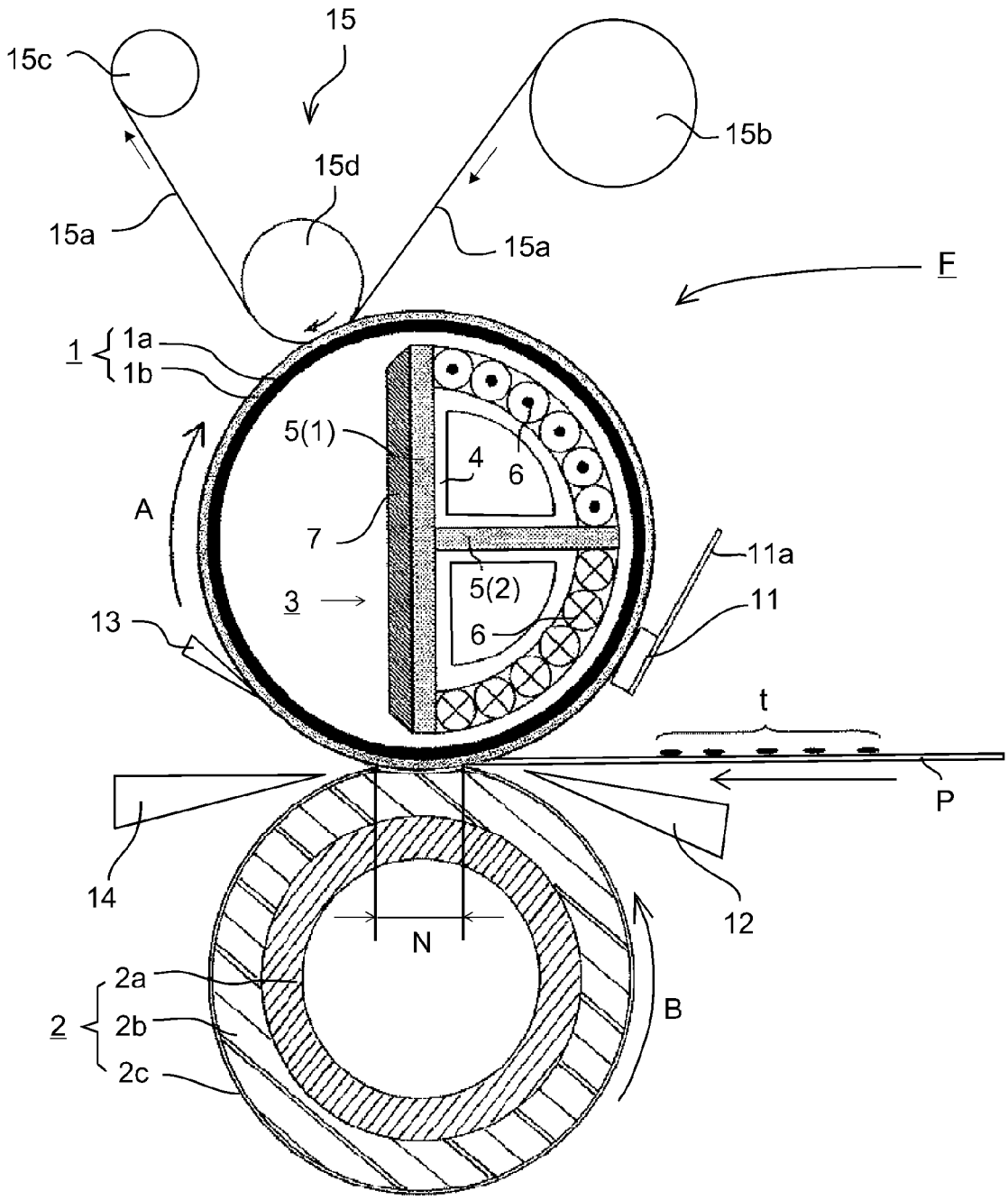
FIG. 2 is a schematic sectional view of the essential portions of the fixing device (heating device based on electromagnetic induction) mounted in the image forming apparatus shown in FIG. 1.
Figure 3:
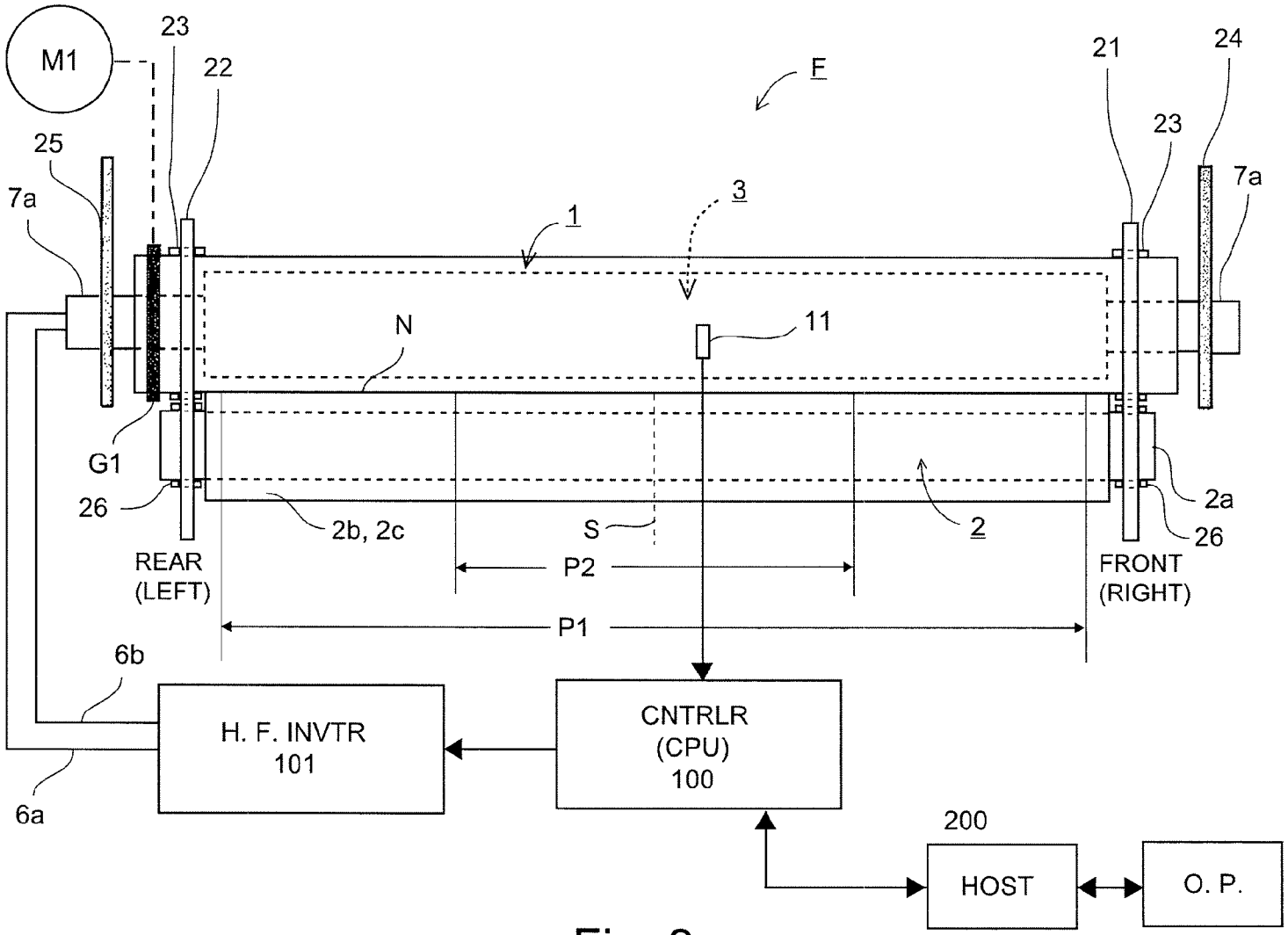
FIG. 3 is a schematic front view of the essential portions of the fixing device shown in FIG. 2.
Figure 4:
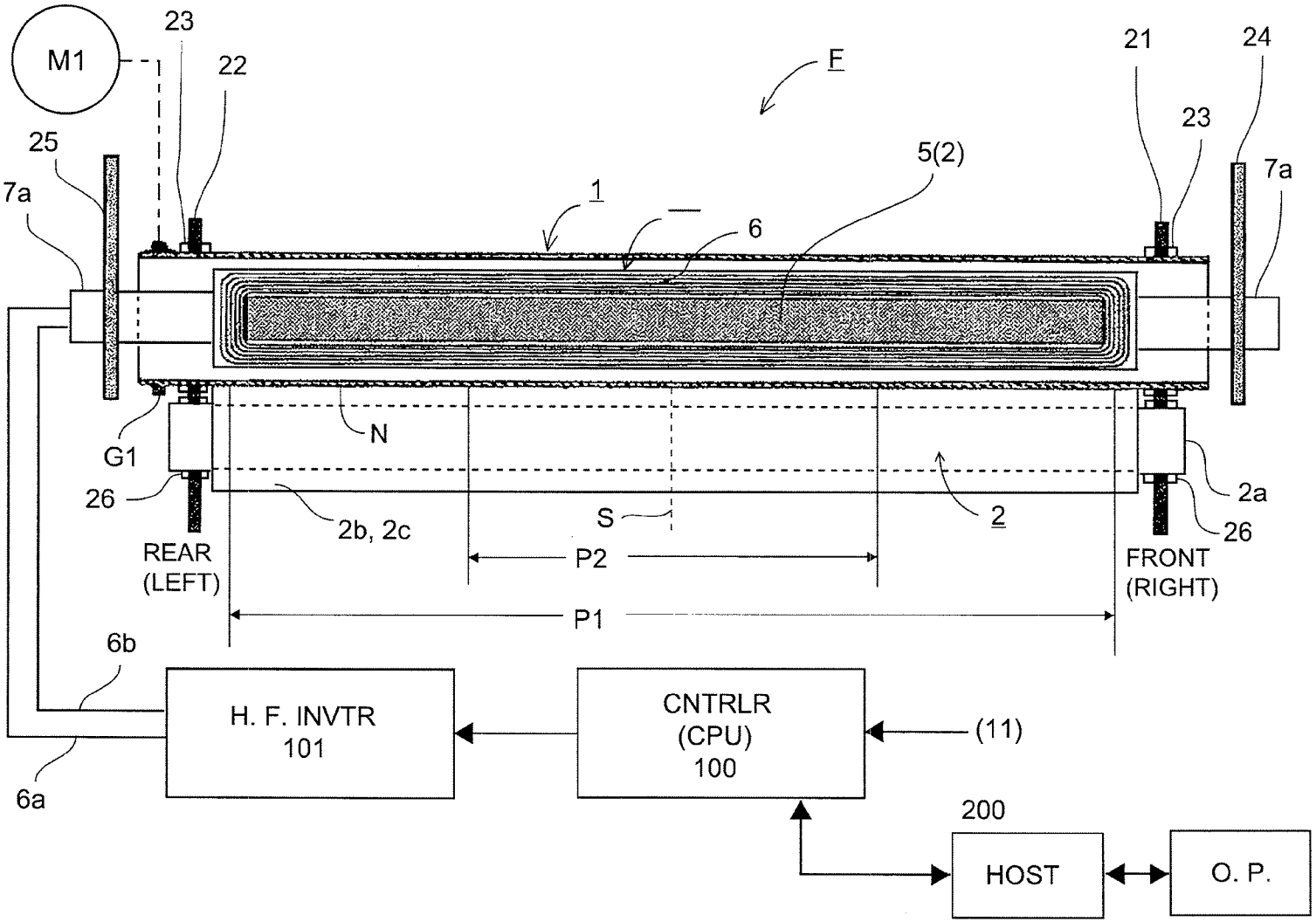
FIG. 4 is a schematic sectional view of the essential portions of the fixing device shown in FIG. 2, at a vertical plane parallel to the lengthwise direction of the device.

FIG. 2 is an enlarged schematic cross-sectional view of the essential portions of the fixing device F. FIG. 3 is a schematic front view of the essential portions of the fixing device F. FIG. 4 is a schematic lengthwise sectional view of the essential portions of the fixing device F. The front surface of the fixing device F is the surface of the fixing device F, which faces the side from which a sheet P of recording paper is introduced into the fixing device F. The left or right side of the fixing device F is the left or right side of the fixing device F as seen from the front side of the device F. This fixing device F is a heating apparatus employing a fixation roller which is heated by electromagnetic induction. It has a pair of rollers, that is, a fixation roller 1 and a pressure roller (pressure applying member) 2, which are positioned in parallel to each other, with the fixation roller 1 being on top of the pressure roller 2, and are kept pressed upon each other by the application of a preset amount of pressure.

The fixation roller 1 is a rotational heating member, at least a part of which is formed of a magnetic shunt alloy adjusted in Curie temperature. In this embodiment, it is a cylindrical roller having a metallic core 1*a* formed of a magnetic shunt alloy, and a surface layer 1*b* formed in a manner to surround the entirety of the peripheral surface of the metallic core 1*a*.

The metallic core 1*a* is 40 mm in external diameter, 0.5 mm in thickness, and 340 mm in length. It is made of magnetic shunt alloy, which is created by mixing iron, nickel, chrome, etc., in such a ratio that its Curie temperature Tc becomes 220° C. The surface layer 1*b* is formed of fluorinated resin such as PFA, TFE, or the like, in order to improve the fixation roller 1 in the parting properties of its peripheral surface. It is 30 μm in thickness. In order to ensure that a high quality image such as a multicolor image, or the like, is satisfactorily fixed, the fixation roller 1 may be provided with a heat resistant elastic layer formed of silicone rubber or the like, which is placed between the metallic core 1*a* and surface layer 1*b*.

The fixation roller 1 is rotatably supported by the front (right) and rear (left) plates 21 and 22, respectively, of the fixation unit frame of the fixing device F. More specifically, the lengthwise ends of the fixation roller 1 are supported by the front and rear plates 21 and 22 of the fixing device F, with the placement of a pair of bearings 23 between the lengthwise ends of the fixation roller 1, and the front and rear plates 21 and 22, one for one. There is disposed in the hollow of the fixation roller 1, a coil assembly 3, as a magnetic field generating means, which induces eddy current in the fixation roller 1 to generate high frequency magnetic field for generating Joule heat in the fixation roller 1.

The pressure roller 2 is an elastic roller made up of a metallic core 2*a* and a heat resistant elastic layer 2*b*, and a surface layer 2*c*. It is 38 mm in external diameter, and 330 mm in length. The metallic core 2*a* is a rigid member which is in the form of a piece of pipe. It is 28 mm in external diameter, and 3 mm in thickness. The heat resistant layer 2*b* is 5 mm in thickness, and covers virtually the entirety of the peripheral surface of the metallic core 2*a*. The surface layer 2*c* is 50 μm in thickness, and is formed of fluorinated resin such as PFA, PTE, or the like, covering virtually the entirety of the outward surface of the heat resistant elastic layer 2*b*. The pressure roller 2 is positioned under the fixation roller 1, in parallel to the fixation roller 1. The lengthwise ends of the metallic core 2*a* are rotatably held by the front and rear plates 21 and 22, one for one, with the placement of a pair of bearings 26 between the front and rear ends of the metallic core 2*a*, and the front and rear plates 21 and 22, respectively.

The fixation roller 1 and pressure roller 2 are kept pressed upon each other by a preset amount of pressure generated by a pressing mechanism (unshown), against the elasticity of the elastic layer 2*b*. Thus, a fixation nip N, which has a preset width in terms of the direction in which a sheet P of recording medium (paper) is conveyed, is formed between the two rollers 1 and 2. The fixation nip N is the portion of the fixing device F, through which a sheet P of recording medium (paper) is conveyed while remaining pinched between the fixation roller 1 and pressure roller 2, and which thermally fixes the toner image on the sheet P while the sheet P is conveyed between the fixation roller 1 and pressure roller 2. In this embodiment, the width of the fixation nip N is roughly 5 mm.

In the following description of the fixing device F, the lengthwise direction of the structural components of the device F is such a direction that coincides with the plane which coincides with the fixation nip N, and also, that is perpendicular to the conveyance direction of the sheet P. As for the center and lengthwise ends of each of the abovementioned structural components, they are the center and lengthwise ends of each structural component in terms of the lengthwise direction of each structural component.

The coil assembly 3, which is disposed in the hollow of the fixation roller 1, is an assembly comprising: a bobbin 4; core members (magnetic cores) 5(1) and 5(2) formed of a magnetic substance; an excitation coil (induction coil) 6; a stay 7 formed of an electrically insulative substance; etc. The magnetic core 5 is held to the bobbin 4. The excitation coil 6 is made up of an electric wire wound around the bobbin 4. A unit made up of the bobbin 4, magnetic core 5, and excitation coil 6 is solidly fixed to, being thereby supported by, the stay 7.

The abovementioned coil assembly 3 is inserted into the hollow of the fixation roller 1 in such an attitude (at preset angle) that a preset amount of gap is provided between the inward surface of the fixation roller 1, and the excitation coil 6, in terms of the direction perpendicular to the lengthwise direction of the fixation roller 1. In this embodiment, the fixing device F is structured so that the lengthwise end portion 7*a* of the stay 7 extend outward of the fixation roller 7 beyond the lengthwise ends of the fixation roller 1 in terms of the lengthwise direction of the fixation roller 1, and are solidly (stationarily) supported by the front and rear supporting member 24 and 25 of the fixing device F. That is, the coil assembly 3 is disposed in the hollow of the fixation roller 1 in the state described above.

The magnetic core 5 is formed of a substance such as ferrite, Permalloy, or the like which is high in permeability and low in residual magnetic flux density. It plays the role of guiding the magnetic flux generated by the excitation coil 6, to the fixation roller 1. The magnetic core 5 in this embodiment is shaped like a letter T in cross-section. It is a combination of two magnetic members 5(1) and 5(2), that is, a portion which corresponds to the horizontal portion of a letter T, and a portion which corresponds to the vertical portion of a letter T.

The excitation coil 6 comprises bound pieces of lit'z wire. Referring to FIG. 4, it is wound several times around the bobbin 4 in such a manner that it encircles the magnetic core 5(2) several times; its contour matches the contour of the inward surface of the fixation roller 1; and the long edges of its contour become parallel to the lengthwise direction of the fixation roller 1. Designated by referential codes 6*a* and 6*b* are a pair of lead wires (coil supply lines) of the excitation coil 6. The lead wires 6*a* and 6*b* are extended outward from the rear end of the stay 7, and are in connection to a high frequency invertor (excitation circuit: high frequency power source) 101 which supplies the excitation coil 6 with high frequency electric current.

Designated by a numeral 11 is a thermistor, as a temperature sensor, which directly, or indirectly, detects the temperature of the fixation roller 1. This temperature sensor 11 will be described later. Designated by a numeral 12 is a pre-fixation guide plate, which guides a sheet P of recording medium (paper) to the entrance of the fixation nip N, as the sheet P is conveyed to the fixing device F from the aforementioned image forming portion. Designated by a numeral 13 is a separation claw, which is for preventing the sheet P from wrapping around the fixation roller 1 after being introduced into the fixation nip N and coming out of the fixation nip N, and also, for separating the sheet P from the fixation roller 1. Designated by a numeral 14 is a post-fixation guide plate, which guides the sheet P of recording paper out of the fixing device F after the sheet P comes out of the exit of the fixation nip N.

The bobbin 4, stay 7, and separation claw 13 are formed of heat resistant and electrically insulative engineering plastic.

Next, a rotational mechanism for rotationally driving the fixation roller 1 is described. This rotational mechanism is provided with a fixation roller drive gear G1 solidly fitted around the rear end portion of the fixation roller 1, and a driving force source M1 which is in connection to the drive gear G1 though a driving force transmitting system. As rotational force is transmitted to the drive gear G1 through the driving force transmitting system from the driving force source M1, the fixation roller 1 is rotationally driven in the clockwise direction indicated by an arrow mark A in FIG. 2. In this embodiment, in the normal paper mode, the fixation roller 1 is rotationally driven at a peripheral velocity (process speed) of 300 mm/sec, whereas in the cardstock mode, it is rotationally driven at a peripheral velocity of 200 mm/sec. The pressure roller 2 is rotated in the counterclockwise direction indicated by an arrow mark B in FIG. 2, by the friction which occurs between the pressure roller 2 and fixation roller 1 as the fixation roller 1 is rotationally driven.

Designated by a numeral 15 is a fixation roller cleaner having: a roll of cleaning web 15*a* as a cleaning means; a shaft 15*b* by which the roll of cleaning web 15*a* is held in such a manner that the cleaning web 15*a* can be unrolled; a take-up shaft 15*c*; a pressing roller 15*d* which presses the portion of the web 15*a*, which is between the two shafts 15*b* and 15*c*, upon the peripheral surface of the fixation roller 1; etc. The peripheral surface of the fixation roller 1 is cleaned by the web pressing roller 15*d*; the toner particles having offset onto the peripheral surface of the fixation roller 1 are wiped away by the portion of the web 15*a*, which is being pressed upon the peripheral surface of the fixation roller 1 by the web pressing roller 15*d*. As the web 15*a* is taken up little by little by the take-up roller 15*c* while the cleaning web 15*a* is unrolled little by little from the shaft 15*b*, the portion of the web 15*a*, which is in the fixation nip N, is replaced little by little by the portion of the cleaning web 15*a*, which is on the upstream side of the fixation nip N in terms of the moving direction of the cleaning web 15*a*.

In this embodiment, a sheet P of recording medium (paper) is conveyed in such a manner that the center of the sheet P coincides with the widthwise center of the recording medium passage of the fixing device F. The width of a sheet P of recording paper is the dimension of the sheet P in terms of the direction perpendicular to the recording medium conveyance direction. A referential letter S in FIG. 3 stands for the central referential line (hypothetical line). That is, the fixing device F is structured so that any sheet P of recording paper, which is conveyable through the fixing device F, is conveyed through the fixing device F, in such a manner that the center of the sheet P in terms of the lengthwise direction of the fixation roller 1, remains coincidental to the center of the fixation roller 1 in the direction parallel to the shaft of the fixation roller 1, regardless of the size of the sheet P.

In terms of the short edges of a sheet P of recording medium, the largest sheet P of recording paper (which hereafter may be referred to simply as large sheet of recording paper) conveyable through the image forming apparatus in this embodiment is A4, for example, in size, and the smallest sheet P of recording paper (which hereafter may be referred to simply as small sheet of recording paper) is RSR, for example, in size. Alphanumeric referential codes P1 and P2 stand for the widths of the paths of the large and small sheets of recording paper, respectively.

The thermistor 11 is a device for detecting the temperature of the center of the peripheral surface of the fixation roller 1 in terms of the lengthwise direction. In terms of the direction parallel to the axial line of the fixation roller 1, the thermistor 11 is positioned at roughly the center portion of the peripheral surface of the fixation roller 1, which corresponds to roughly the center of the path P2 of a sheet P of recording paper of the small size, in such a manner that it opposes the excitation coil 6, with the presence of the fixation roller 1 between itself and excitation coil 6. It is kept pressed upon the peripheral surface of the fixation roller 1 by an elastic member 11*a* so that it remains in contact with the peripheral surface of the fixation roller 1. The output (temperature detection signal) is inputted into the control circuit (CPU) 100, which is the control section of the image forming apparatus.

(2-2) Fixing Operation

As the main power source switch (unshown) of the image forming apparatus is turned on, the control circuit 100 of the image forming apparatus starts up the apparatus to begin controlling the preset image formation sequence. As for the fixing device F, its fixation roller 1 begins to be rotated by the starting up of the driving force source M1. Consequently, the pressure roller 2 begins to be rotated by the rotation of the fixation roller 1. Further, the control circuit 100 starts up the high frequency invertor (electric power source) 101 to flow high frequency (10 kHz-100 kHz, for example) current through the excitation coil 6.

As a result, alternating high frequency magnetic flux is generated around the excitation coil 6, causing thereby the fixation roller 1 to be inductively heated. Thus, the temperature of the fixation roller 1 rises toward a preset fixation level T while it is detected by the thermistor 11. As the fixation roller 1 is inductively heated, the control circuit 100 controls the electric power, which is being supplied to the excitation coil 6 from the high frequency invertor 101, so that the detected temperature of the fixation roller 1, which is inputted into the control circuit 100 from the thermistor 11, remains at the preset target level T. That is, the control circuit 100 controls the temperature of the fixation roller 1 so that the temperature of the fixation roller 1 remains at the preset target level. More concretely, the control circuit 100 increases or decreases the amount by which electric current is supplied to the excitation coil 6 from the electric power source 101, in proportion to the difference between the target temperature level T and the temperature level detected by the thermistor 11. For example, the greater the difference between the target temperature level T and the temperature level detected by the thermistor 11, the greater the amount by which electric current is supplied to the excitation coil 6; the smaller the difference between the target temperature level T and the temperature level detected by the thermistor 11, the smaller the amount by which electric current is supplied to the excitation coil 6. Further, when the temperature level detected by the thermistor 11 is higher than the target temperature level T, the control circuit 100 stops supplying the excitation coil 6 with electric current. Incidentally, when increasing or decreasing the amount by which electric current is supplied to the excitation coil 6, the alternating current may be increases or decreased, respectively, in frequency.

While the temperature of the fixation roller 1 is being controlled as described above, a sheet P of recording paper, on which an unfixed toner image t is present, is introduced into the fixation nip N from the image forming portion side of the fixation nip N, and is conveyed through the fixation nip N while remaining pinched between the fixation roller 1 and pressure roller 2. Thus, the unfixed toner image t on the sheet P of recording paper is thermally fixed to the surface of the sheet P by the heat from the fixation roller 1 and the internal pressure of the fixation nip N.

In this embodiment, the target temperature level was set to 90° C. for both the normal paper mode and cardstock mode. However, in order to improve the fixing device F in the fixation of a toner image to cardstock, the target temperature level for the cardstock mode may be set higher than that for the normal paper mode. Further, in consideration of the difference in glossiness between a toner image fixed to a sheet of normal paper, and a toner image fixed to a sheet of cardstock, which is attributable to the fact that the cardstock mode is slower in recording medium conveyance speed than the normal paper mode, the cardstock mode may be made lower in target temperature level T than the normal paper mode. In either case, however, when switching is made between the normal paper mode and cardstock mode, it is required to heat or cool the fixation roller 1. Therefore, it is desired that the normal paper mode and cardstock mode are made the same in target temperature level T.

(2-3) Electromagnetic Induction Heating Principle

Figure 5:
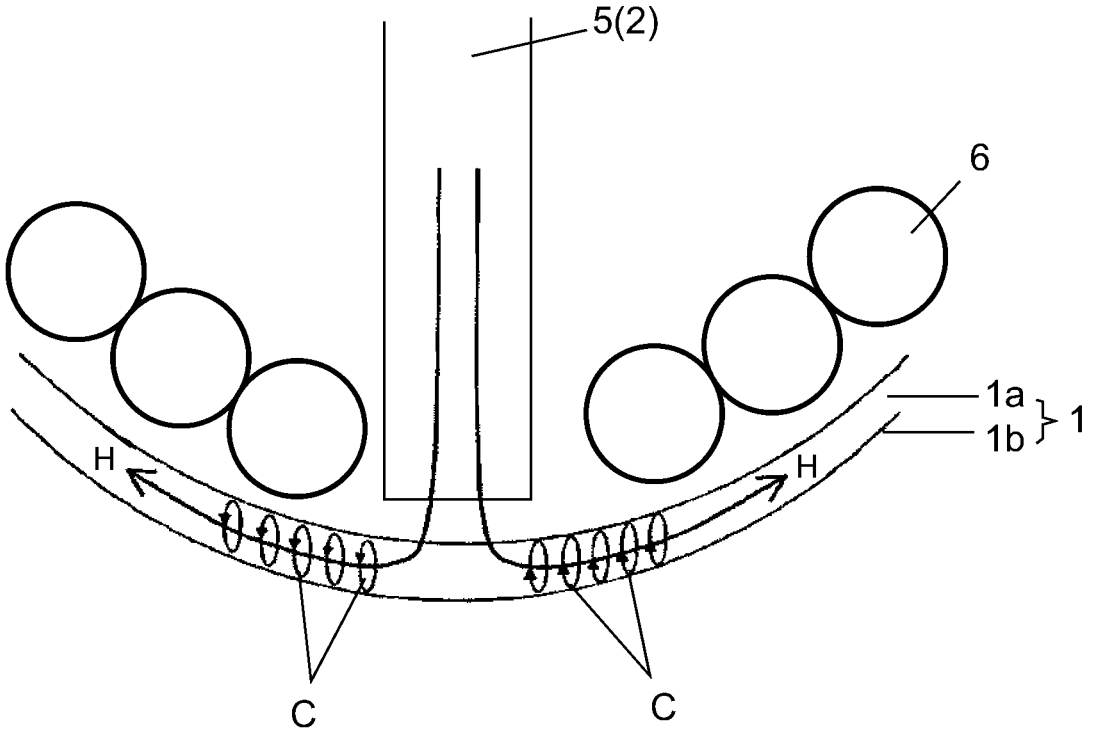
FIG. 5 is a drawing for describing the heat generation principle of the fixation roller of the fixing device shown in FIG. 2.

Next, referring to FIG. 5, the electromagnetic induction heating principle of the metallic core 1*a* of the fixation roller 1, which is an electrically conductive member, is described. To the excitation coil 6, alternating high frequency electric current is supplied. Thus, the magnetic flux indicated by an arrow mark H is repeatedly generated, and then, disappear, around the excitation coil 6. The magnetic flux H is guided along the magnetic path provided by the magnetic cores 5(1) and 5(2). In response to the changes in the magnetic flux generated by excitation coil 6, eddy current is generated in the metallic core 1*a* in such a manner that the eddy current generates a magnetic in the direction to counter the changes in the magnetic flux generated by the excitation coil 6. This eddy current is indicated by an arrow mark C.

This eddy current C concentrates into the portion of the surface portion of the metallic core 1*a*, which faces the excitation coil 6 (skin effect). Thus, heat is generated in the surface portion of the metallic core 1*a* by the amount which is proportional to the skin resistance Rs of the metallic core 1*a*. There is the following relationship (mathematical equations 1 and 2) among the frequency f (Hz) of the alternating current supplied to the excitation coil 6, permeability μ (H/m) of the metallic core 1*a*, skin depth δ (m) obtainable from the specific resistance p (Ω·m) of the metallic core 1*a*, and skin resistance Rs (Ω).

$$\delta = \sqrt{\frac{\rho}{\pi \mu f}} \tag{1}$$

$$Rs = \frac{\rho}{\delta} = \sqrt{\pi \mu f \rho} \tag{2}$$

Further, the amount $I_f$(A) by which eddy current is induced in the metallic core 1*a* is proportional to the amount by which the magnetic flux passes through the metallic core 1*a*. Therefore, the amount by which eddy current is induced in the metallic core 1*a* can be expressed in the form of the following mathematical equation 3, in which a letter N stands for the number of windings of the excitation coil 6, and I (A) stands for the amount by which the excitation coil 6 is supplied with electric current.

$$I_f \propto NI \tag{3}$$

The electric power W (W) generated in the metallic core 1*a* is Joule heat, which is attributable to the combination of the amount If by which eddy current is induced in the metallic core 1*a*, and the skin resistance Rs (Ω) of the metallic core 1*a*. Therefore, the amount W by which electric power is generated in the metallic core 1*a* can be obtained with the use of mathematical equation 4:

$$W = Rs \cdot I_f^2 \propto \sqrt{\mu f \rho}(NI)^2 \tag{4}$$

It is evident from Equation 4 that, from the standpoint of increasing the amount by which heat is generated in the metallic core 1*a*, it is desirable to use a ferromagnetic metallic substance such as iron and nickel, or alloy thereof, which is high in permeability (large in μ), and highly resistant (large in ρ), as the material for the metallic core 1*a*, or to increase the excitation coil 6 in the number of windings of its wire.

Further, the high frequency invertor 101 can be controlled in the electric current I in terms of the amount or frequency f, in order to optimize the amount by which heat is generated in the metallic core 1*a*.

(2-4) Curie Temperature

Next, Curie temperature Tc is described. Generally speaking, as a ferromagnetic substance is heated until its temperature reaches its Curie temperature Tc, which is specific to the substance, it loses its spontaneous magnetization. Consequently, the permeability μ of this ferromagnetic substance becomes roughly equal to the permeability $\mu_0$ of vacuum, and remains stable at that level. Therefore, as the temperature of the metallic core 1*a* of the fixation roller 1, which is an electrically conductive member, exceeds its Curie temperature Tc, the metallic core 1*a* reduces in the amount W by which heat is generated therein.

Figure 6:
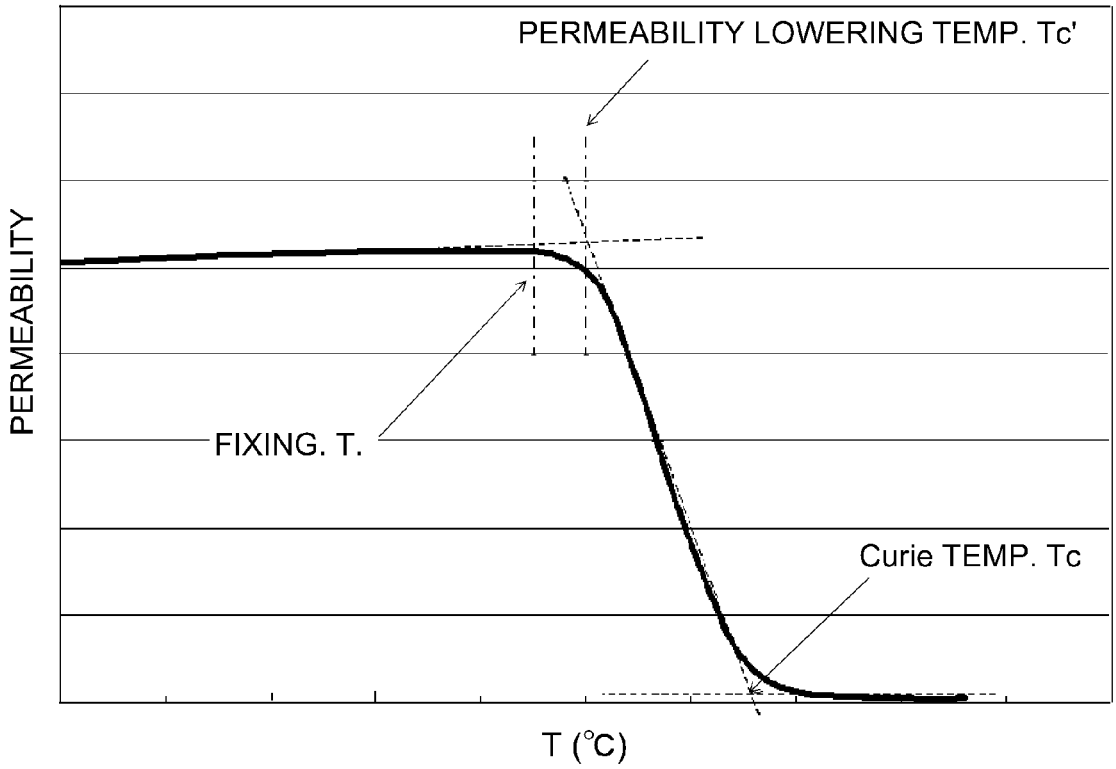
FIG. 6 is a drawing which shows the relationship between the permeability of a magnetic component preset in Curie temperature, and the temperature of the magnetic component.

In reality, however, this does not mean that as the temperature of a ferromagnetic substance exceeds the Curie temperature Tc of the substance, the substance suddenly changes in permeability μ. That is, the substance begins to change in permeability at a level Tc' which is lower than the Curie temperature Tc, as shown in FIG. 6. In the case of the metallic core 1*a* in this embodiment, the level Tc' at which the metallic core 1*a* begins to reduce in permeability is 200° C., whereas its Curie temperature Tc is 220° C.

In a case where the thickness of the metallic core 1*a* is t (m), as the metallic core 1*a* increases in temperature, and the skin depth δ of the metallic core 1*a* becomes greater than the thickness t of the metallic core 1*a*, the eddy current induced in the metallic core 1*a* flows through the entirety of the metallic core 1*a* in terms of the cross-section of the metallic core 1*a*. In this case, therefore, the amount (Ω) of the skin resistance Rs' of the metallic core 1*a*, and the amount W' (W) by which heat is generated in the metallic core 1*a*, are obtainable with the use of the following mathematical equations 5 and 6, respectively:

$$Rs' = \frac{\rho}{t} \tag{5}$$

$$W' = Rs' * If^2 \propto \frac{\rho}{t}(NI)^2 \tag{6}$$

According to Equation 6, in a case where the temperature of the out-of-sheet-path portions of the metallic core 1*a* increases close to the Curie temperature Tc, and the skin depth ρ of the metallic core 1*a* becomes greater than the thickness of the metallic core 1*a*, the following control is possible. That is, the amount by which heat is generated in the out-of-sheet-path portions of the metallic core 1*a*.core 1*a* can be optimized by controlling the electric current I to be supplied to the excitation coil 6 from the high frequency invertor 101. Also according to Equation 6, in a case where the temperature of the out-of-sheet-path portions of the metallic core 1*a* is higher than the Curie temperature Tc, the amount by which heat is generated in the metallic core 1*a* is not dependent upon the alternating current frequency f. Incidentally, according to Equation 4, when the temperature of the out-of-sheet-path portions of the metallic core 1*a* is no higher than the Curie temperature, the amount by which heat is generated in the metallic core 1*a* is dependent upon the alternating current frequency f.

Next, the saturation temperature of a fixation roller formed of a magnetic shunt alloy, the Curie temperature of which has been adjusted to a preset level is described. Under such a condition that the relationship between the amount W' (W), by which heat is generated in the out-of-sheet-path portions of the fixation roller 1, and which is obtainable with the use of Equation 6, and the amount Q (W) by which heat radiates from the metallic core 1*a*, satisfies a mathematic formula 7, the surface temperature of the fixation roller 1 becomes stable at a preset saturation temperature Ts.

$$W' \leq Q \tag{7}$$

The amount Q (W) by which heat radiates from the metallic core 1*a* is the sum of the amount Q1 (W) by which heat transfers from the fixation roller 1 to the pressure roller 2, and the amount Q2 (W) by which heat transfers to the ambience of the metallic core 1*a*. Strictly speaking, it should include the loss attributable to the heat transfer from the surface of the metallic core 1*a* to the surface of the fixation roller 1. However, this loss is very small compared to the amount Q1 or Q2. Therefore, it is not taken into consideration here.

Therefore, the amount Q (W) by which heat radiates from the fixation roller 1 can be expressed in the form of the following mathematical equation 8:

$$Q=Q_1+Q_2=h_1A_1(Ts-T_1)+h_2A_2(Ts-T_2) \tag{8}$$

It is assumed here that the area of the portions of the out-of-sheet-path portions of the nip between the fixation roller 1 and pressure roller 2 is A1 ($m^2$); the area by which the fixation roller 1 is in contact with the ambience is A2 ($m^2$); the saturation temperature of the out-of-sheet-path portions of the fixation roller 1 is Ts (° C.); the temperature of the out-of-sheet-path portions of the pressure roller 2 is T1 (° C.); the ambient temperature is T2 (° C.); the thermal conductivity from the surface of the fixation roller 1 to the surface of the pressure roller 2 is h1 ($W/m^2 \cdot k$); and the thermal conductivity from the surface of the fixation roller 1 to the ambience is h2 ($W/m^2 \cdot k$). The thermal conductivities h1 and h2 are coefficients which are determined by the material and shape of the fixation roller 1, rotational speed of the fixation roller 1, etc. Thus, the slower the fixation roller 1 in rotational speed, the lower it is in thermal conductivity.

The amount W' by which heat is generated in the out-of-sheet-path portions of the fixation roller 1 is stable. Therefore, based on Equation 7 given above, as the fixation roller 1 reduces in rotational speed, it reduces in the amount of heat radiation, and therefore, it increases in the saturation temperature Ts of its out-of-sheet-path portions.

(2-5) Multiple Heating Modes

Generally speaking, some fixing devices which can be operated in multiple modes (multicolor image formation mode, monochromatic image formation mode; normal paper mode, cardstock mode, OHP mode, etc.) can be changed (switched) in process speed (rotational speed of fixation roller). That is, they can be changed in recording medium conveyance speed according to the selected operational mode. For example, as one of the multiple operational modes is selected through the control panel (unshown) with which the image forming apparatus is provided, the information of the selected mode is inputted into the control circuit 100, which adjusts the image forming apparatus in process speed according to the selected mode.

As described above, the slower the process speed, the smaller the amount of heat radiation from a fixation roller as a heating member, and therefore, the higher the saturation temperature which is affected by the spontaneous temperature control properties of a magnetic shunt substance. Therefore, when an image forming apparatus is slow in process speed, the temperature increase of the out-of-sheet-path portions of the fixation roller 1 is significantly greater than when the apparatus is high in process speed. Therefore, it is when the apparatus is slow in process speed, that hot offset, wrinkling of recording paper, and/or the like problem occur.

More concretely, in this embodiment, the normal paper mode is the first heating mode in which a sheet P of recording medium (ordinary recording paper) is heated while being conveyed at the first speed (process speed), and the cardstock mode is the second heating mode in which a sheet of recording medium (cardstock) is heated while being conveyed at the second speed (process speed) which is lower than the first speed. In the cardstock mode, which is slower in recording medium conveyance speed (rotational speed of fixation roller 1) than the normal paper mode, the out-of-sheet-path portions of the fixation roller 1 become substantially higher in temperature than the sheet-path portion of the fixation roller 1. Therefore, in such a case where an image on a sheet of ordinary paper is thermally fixed immediately after the completion of the image forming operation carried out in the cardstock mode, it sometimes occurs that the sheet P is wrinkled and/or a scratchy image (print) is outputted.

In this embodiment, therefore, the maximum amount by which electric current is supplied to the excitation coil 6 in the normal paper mode is made greater than that in the cardstock mode. This is one of the characteristics of this embodiment. Conversely, the cardstock mode is made smaller in the amount by which electric current is flowed through the excitation coil 6 than the normal paper mode. Therefore, it is possible to make the saturation temperature of the out-of-sheet-path portions of the fixation roller 1 in the cardstock mode no more than the saturation temperature of the out-of-sheet-path portions of the fixation roller 1 in the normal paper mode.

As described above, in the cardstock mode, the amount by which excitation coil 6 is supplied with electric current is reduced to reduce the amount by which heat is generated in the fixation roller 1 when the temperature of the metallic core 1*a* is no less than the Curie temperature. Thus, even in the cardstock mode which is relatively slow in process speed, it is possible to prevent the out-of-path portions of the fixing roller 1 from increasing in saturation temperature. Therefore, even immediately after the completion of an image forming operation in the cardstock mode, it is possible to prevent the image forming apparatus from outputting a wrinkly print, scratchy prints, and/or the like.

In one of the experiments in which 1,000 sheets P of recording paper, which is A4 in size and 80 $g/m^2$ in basis weight, were continuously conveyed through the fixing device F in this embodiment which is structured as described above, in the normal paper mode (190° C. in fixation temperature, and 300 mm/sec in conveyance speed), with the maximum amount by which high frequency electric current is supplied to the excitation coil 6 set to 30 A, the saturation temperature Ts of the out-of-sheet-path portions of the fixation roller 1 was 215° C., and the difference ΔT in temperature between the sheet-path portion and out-of-sheet-path portions of the fixation roller 1 was 25° C. Immediately after the completion of this image forming operation, sheets of recording medium (ordinary recording paper) which is A3 in size and 64 $g/m^2$ in basis weight were continuously conveyed through the image forming apparatus (fixing device F). The image forming apparatus did not yield unsatisfactory prints such as a wrinkly print, a scratchy print, and/or the like.

On the other hand, in an image forming operation in the cardstock mode (190° C. in fixation temperature, and 250 mm/sec in conveyance speed) in which the maximum amount by which high frequency electric current is to be supplied to the excitation coil 6 was set to 30 A, which is the same as the one in the normal paper mode, 1,000 sheets P of cardstock were continuously conveyed. In this case, the saturation temperature Ts of the out-of-sheet-path portions of the fixation roller 1 was 215° C., and the temperature difference ΔT between the sheet-path portion and out-of-sheet-path portions of the fixation roller 1 was 35° C. Then, immediately after the completion of this continuous image forming operation, sheets P of recording paper which were 64 g/m$^2$ in basis weight and A3 in size were conveyed through the image forming apparatus (fixing device F). In this case, wrinkly prints were outputted.

In comparison, in this embodiment, as the cardstock mode was selected, the maximum amount by which high frequency electric current is to be supplied to the excitation coil 6 was set to 25 A. In an image forming operation in the cardstock mode in which 1,000 sheets of cardstock which was 350 g/m$^2$ in basis weight and A4R in size were continuously conveyed through the image forming apparatus (fixing device F), the saturation temperature Ts of the out-of-sheet-path portions of the fixation roller 1 was 213° C., and the temperature difference ΔT between the sheet-path portion and out-of-sheet-path portions of the fixation roller 1 was 23° C. Then, immediately after the completion of this image forming operation in the cardstock mode, sheets of ordinary recording paper which is 64 g/m$^2$ in basis weight and A3 in size were conveyed in the normal paper mode. In this case, unsatisfactory prints such as wrinkled prints, scratchy prints, and/or the like were not outputted.

That is, in the case of the configuration of the image forming apparatus (fixing device F) in this embodiment, the cardstock mode which is slower in recording medium conveyance speed than the normal paper mode was made less in the maximum amount by which high frequency electric current is to be supplied to the excitation coil 6 than the normal paper mode. Thus, the former was made less in the amount W' by which heat is generated in the out-of-sheet-path portions of the fixation roller 1 than the latter, and therefore, it was possible to make the temperature of the out-of-sheet-path portions of the fixation roller 1 no more than the saturation temperature of the fixation roller 1 in the normal paper mode. Therefore, even in the cardstock mode, the temperature difference between the sheet-path portion and out-of-sheet-path portions of the fixation roller 1 was relatively small. Therefore, even if sheets of thin paper or the like were conveyed immediately after the completion of an image formation in the cardstock mode, unsatisfactory prints such as wrinkled prints, scratchy prints, and/or the like were not outputted. In other words, this embodiment can improve an image forming apparatus in terms of the prevention of such problem that as sheets of relatively thin sheets of recording paper are conveyed through an image forming apparatus (fixing device) immediately after the completion of an image forming operation in the cardstock mode, the apparatus is likely to output wrinkly prints, scratchy prints, and/or the likes.

The structure and configuration of the fixing device F in this embodiment are nothing but examples of structure and configuration for a fixing device, which are in accordance with the present invention. That is, the present invention is also applicable to fixing devices which are different from the image forming device F in this embodiment, in recording paper type, process speed, etc.

Further, the fixing device F in this embodiment is enabled to operate in only two modes, that is, the normal paper mode, and the cardstock mode which is slower in recording medium conveyance speed than the normal paper mode. However, the present invention is also applicable to any fixing device as long as the devices are enabled to operate in multiple modes.

For example, the present invention is applicable to a fixing device which can be operated in the thickest cardstock mode, as the third mode, which is higher in fixation temperature than the cardstock mode, in addition to the normal paper mode and cardstock mode. Operational modes which are smaller in recording medium conveyance speed than the normal paper mode may be the glossing mode for increasing an image in gloss, OHT mode for outputting transparent images for an OHT, which are superior in transparency, in addition to the mode for cardstock, coated paper, and the like. Further, the present invention is also applicable to image forming apparatuses, the recording medium conveyance speed of which in the monochromatic mode is different from their multicolor mode.

Conversely, the present invention is applicable to a fixing device which is provided with a mode in which recording medium conveyance speed is faster than that in the normal paper mode. For example, the present invention is applicable to a fixing device having a thin paper mode which is faster in recording medium conveyance speed than the normal paper mode.

Regarding the switching of recording medium conveyance speed, the present invention is also applicable to an image forming apparatus which is not changeable in recording medium conveyance speed, except for the recording medium conveyance speed in its fixing device F; it changes the speed with which a sheet P of recording medium is conveyed according to recording medium type, only as the sheet P is introduced into the fixing device F.

Further, the configuration of the fixing device in this embodiment is compatible with the dimension of a sheet of cardstock in terms of the widthwise direction. For example, in a case where a sheet of cardstock of a large size, the dimension of which in terms of the widthwise direction of the recording medium passage, is close, or equal, to the width of the recording medium passage is conveyed through the fixing device F, an expected amount of temperature increase across the out-of-sheet-path portions of the fixation roller 1 is very slight even when the fixing device is reduced in recording medium conveyance speed. Therefore, when a sheet of cardstock of a large size, such as the one described above, is conveyed in the above descried attitude, the coil current I is not reduced; it is reduced only when a sheet of cardstock, or the like, which is relatively small in size is heated, and therefore, it is expected that the out-of-sheet-path portions of the fixation roller 1 excessively increases in temperature.

Embodiment 2

In the first embodiment described above, the coil current I is to be reduced only in the cardstock mode which is slower in recording medium conveyance speed than the normal paper mode. However, it is possible that as the coil current I is reduced, the amount by which heat is generated in the fixation roller 1 (that is, amount by which heat is generated in sheet-path portion of fixation roller 1) reduces, as will be evident from above described Equation 4, when the temperature of the fixation roller 1 is lower than the permeability-reduction-start-temperature Tc', and therefore, it is possible that unsatisfactory fixation will occur.

Therefore, in a case where a sheet of cardstock, which is thicker (for example, 400 g/m$^2$ in basis weight) than the cardstock mentioned in the description of the first embodiment, is heated, or the ambient temperature of the image forming apparatus is very low (for example, when apparatus is operated in a room which is 5° C. in temperature), a fixing device structured like the one in the first embodiment is reduced in the amount by which heat is generated in the sheet-path portion of its fixation roller, which possibly results in unsatisfactory fixation.

The configuration, in this embodiment, for a fixing device is for avoiding unsatisfactory fixation such as the one described above. Hereafter, this embodiment of the present invention is described. In the case of the fixing device configuration in this embodiment, in the normal paper mode, and also, in the cardstock mode which is slower in the peripheral velocity of the fixation roller than the normal paper mode, not only is the alternating electric current (coil current I) to be supplied to the excitation coil 6 changed in the amount, but also, in the frequency (frequency f of coil current).

According to Equation 4 given above, when the temperature of the metallic core 1*a* of the fixation roller 1 is lower than the permeability-reduction-start temperature Tc' (which corresponds to sheet-path portion), the amount W by which heat is generated in the metallic core 1*a* is affected by both the coil current I (variable) and frequency (variable) of coil current. On the other hand, according to Equation 6 given above, as the temperature of the metallic core 1*a* of the fixation roller 1 increases close to Curie temperature Tc (which corresponds to excessive temperature increase across out-of-sheet-path portions of metallic core 1*a*), the amount W' of heat generation is affected by only the coil current I. Therefore, in a case where the coil current I is reduced to reduce the amount W' by which heat is generated in the out-of-sheet-path portions of the metallic core 1*a*, the amount W by which heat is generated in the sheet-path portion of the metallic core 1*a* can be compensated for the heat loss attributable to the reduction in the coil current I, by increasing the coil current in frequency.

In the case of the fixing device (image forming apparatus) configuration in this embodiment, the amount and frequency of the coil current in the normal paper mode are 30 A and 20 kHz, respectively. The amount and frequency of the coil current in the cardstock mode are 25 A and 40 kHz. When 1,000 sheets of cardstock which were A4R in size and 400 g/m$^2$ in basis weight were continuously heated in the above described cardstock mode, unsatisfactory fixation did not occur; satisfactory images (prints) were outputted. Then, immediately after the completion of the above described image forming operation, sheets of recording paper which were A3 in size and 64 g/m$^2$ in basis weight were heated in the normal paper mode. Also in this case, it did not occur that unsatisfactory prints (images) such as wrinkly prints, scratchy prints, and the like are outputted.

As described above, in the second embodiment, the cardstock mode which is lower in recording medium conveyance speed than the normal paper mode was made smaller in the maximum amount by which high frequency electric current is supplied to the excitation coil 6 than the normal paper mode, and also, was made higher in the frequency of the high frequency electric current supplied to the excitation coil.

With the employment of the above described configuration, it was possible to reduce the amount W' by which heat is generated in the out-of-sheet-path portion of the fixation roller, while maintaining the amount W by which heat is to be generated in the sheet-path portion of the fixation roller, at the desired level. Therefore, it was possible to make the temperature of the out-of-sheet-path portion of the fixation roller no higher than the saturation temperature in the normal paper mode. Therefore, it was possible to reduce the temperature difference between the sheet-path and out-of-sheet-path portions of the fixation roller, even in the cardstock mode. Therefore, it was possible to improve an image forming apparatus (fixing device F) in terms of unsatisfactory fixation, that is, the problem that when sheets of thin paper are used as recording medium, wrinkly prints, scratchy image, and/or the like are outputted.

Also in this embodiment, the cardstock mode which is slower in recording medium conveyance speed than the normal paper mode was made higher in the frequency of the high frequency electric current supplied to the excitation coil 6 than the normal paper mode. Therefore, even if the amount by which electric current is supplied to the excitation coil is reduced, the amount by which heat is generated in the sheet-path portion of the fixation roller remains satisfactory. Therefore, it was possible to improve an image forming apparatus (fixing device) in terms of unsatisfactory fixation, that is, the problem that wrinkly prints, scratchy prints, and/or the like are outputted when an image forming operation is carried out in the normal paper mode immediately after the completion of an image forming apparatus in the cardstock mode.

Incidentally, the configuration of the fixing device (image forming apparatuses) in this embodiment may be altered as necessary in recording medium type, process speed, etc., as that in the first embodiment.

Embodiment 3

Figure 7:
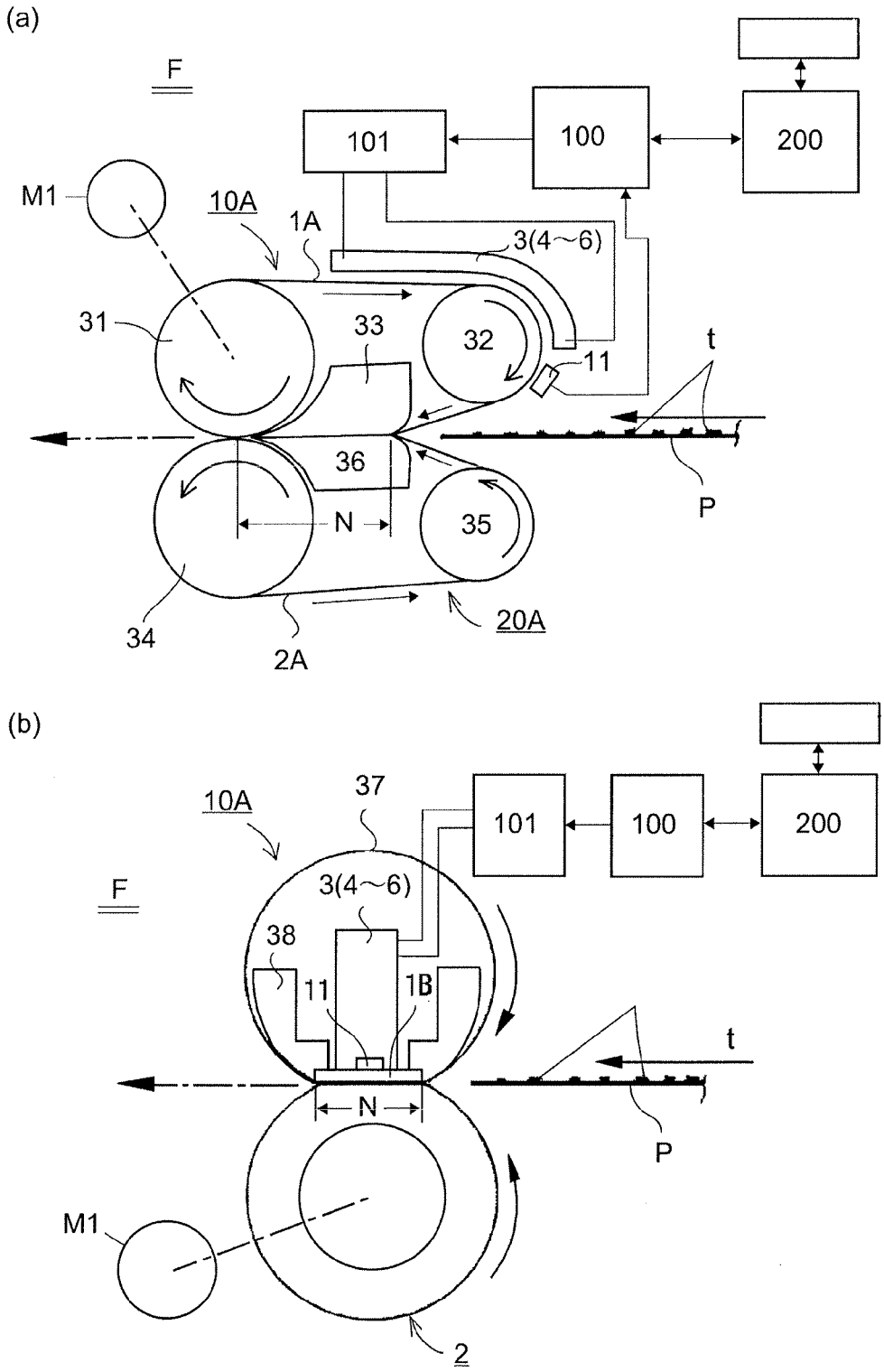
FIGS. 7(*a*) and 7(*b*) are schematic sectional views of the fixing device in the third embodiment of the present invention, at vertical planes parallel to the recording medium conveyance direction of the fixing device.

The heating member does not need to be in the form of a roller. For example, it may be in the form of a rotational member such as an endless belt. FIG. 7(*a*) is a schematic sectional view of an example of fixing device F, the heating member of which is an endless belt. This apparatus has a heat belt unit 10A and a pressure belt unit 20A, which are pressed upon each other to form a fixation nip N which is greater in dimension in terms of the direction in which a sheet P of recording medium (paper) is conveyed, than the fixing devices in the preceding embodiments.

The unit 10A has a flexible and endless fixation belt 1A, which is suspended and kept tension by the first and second rollers 31 and 32, and a pressure pad 33. The belt 1A is a heating member, in which heat is generated by electromagnetic induction. It has a magnetic shunt alloy layer having a preset Curie temperature. There is disposed on the outward side of the belt 1A, a coil assembly 3 (external heating means), as a magnetic field generating member, which is for inductively heating the belt 1A. The unit 20A has a flexible and endless pressure belt 2A, which is suspended and kept tensioned by the first and second rollers 34 and 35, and a pressure pad 36.

As rotational force is transmitted from a driving force source M1 to the first roller 31 of the unit 10A, the belt 1A is rotationally driven in the clockwise direction indicated by an arrow mark at a preset peripheral velocity (process speed). The belt 2A of the unit 20 is rotated by the rotation of the belt 1A. The belt 1 is inductively heated by the coil assembly 3. The control of this fixing device F is similar to that of the fixing device F in the second embodiment.

Regarding the structure of the fixing device F shown in FIG. 7(*a*), the fixing device F may be structured so that the first roller 31 of the unit 10A is internally or externally heated by electromagnetic induction, and a heat resistant belt, as the substitute for the endless belt 1A, is heated by the first roller 31. Further, the fixing device F may be structured so that the belt 21A or first roller 34 of the unit 20A is also heated by electromagnetic induction.

Further, the fixing device F may be structured so that the heating member is stationary, and a sheet P of recording paper is heated by an endless belt, or a roll of belt, which is made to slide on the stationary heating member. FIG. 7(*b*) is a schematic sectional view of an example of fixing device F, the heating member of which is stationary.

The device has a fixation nip N which is formed by pressing the heat belt unit 10A and elastic pressure roller 2 of the device upon each other, with the placement of the belt 37 between the heat belt unit 10A and elastic pressure roller 2, and which is relatively large in dimension in terms of the recording medium conveyance direction. The unit 10A comprises: a heat resistant guide 38, which is in the form of a gutter which is roughly semicircular in cross-section; and a pressing member 1B, which is a long and narrow piece of thin plate fixed to the guiding member 38 in parallel to the long edges of the guiding member 38. The pressing member 1B is formed of magnetic shunt alloy preset in Curie temperature. There is disposed on the inward side of the guiding member 38, a coil assembly 3 as a magnetic field generating means for inductively heating the pressing member 1B. Further, the flexible and heat resistant belt 37, which is cylindrical, is loosely fitted around the above-described guiding member 38.

The pressure roller 2 is pressed against the pressing member 1B of the above described unit 10A, with the placement of the belt 37 between the pressure roller 2 and pressing member 1B, forming a fixation nip N between the pressure roller 2 and belt 37. As rotational force is transmitted to the pressure roller 2 from a driving force source M1 through a transmitting system, the belt 37 of the unit 10A is rotated by the rotation of the pressure roller 2, in such a manner that the inward surface of the belt 37 slides on the pressing member 1B while remaining in contact with the pressing member 1B. The pressing member 1B, which is stationary, is inductively heated by the coil assembly 3. The control of this fixing device F is similar to that of the fixing devices in the first and second embodiments.

(Miscellanies)

1) A heating apparatus of the so-called electromagnetic induction type, which is in accordance with the present invention, is not limited in usage. That is, not only can it be used like the image heating devices in the first, second, and third embodiments described, but also, it can be effectively used as a fixing apparatus for provisionally fixing an unfixed image to a sheet of recording paper, a surface property altering (improving) apparatus for reheating a sheet of recording paper bearing a fixed image, in order to altering the image in surface properties such as gloss, etc.

Obviously, it is also effective as a thermal pressing apparatus for removing wrinkles from paper money and the like, a thermal laminating machine, a thermal drying machine for evaporating moisture in paper money and the like, and a heating apparatus for thermally processing an object in the form of a sheet.

2) The heating members 1, 1A, 1B may be formed of an electrically conductive substance alone, which can be inductively heated, or may be formed as a multilayer member having two or more layers which include an electrically conductive layer, and another layer formed of heat resistant resin, ceramic, or the like.

3) The temperature detecting means 11 does not need to be limited to a thermistor. All that is required of the temperature detecting means 11 is that it is a temperature detecting element. Further, it may be of the so-called direct type, or the so-called indirect detection type.

4) The fixing devices in the forgoing embodiments of the present invention were configured to convey a sheet of recording medium (recording paper), as an object to be heated, in such a manner that the center of a sheet of recording medium coincides with the center of the recording medium conveyance passage of the fixing device, in terms of the widthwise direction of the passage. However, the present invention is also effectively applicable to an image heating apparatus structured so that a sheet of recording medium is conveyed in such a manner that one of the edges of the sheet remains in contact with the corresponding edge of the recording medium passage of the image heating apparatus.

5) Further, the image heating apparatuses (devices) in the preceding embodiments are structured so that they deal with only two kinds of sheet of recording paper in terms of size. However, the present invention is also applicable to an image heating apparatus through which three or more kinds of sheet of recording paper, in terms of size, can be conveyed.

6) Further, the image heating apparatuses (devices) in the preceding embodiments are structured so that they can be operated in only two modes, that is, the normal paper mode and cardstock mode, which are different in recording medium conveyance speed. However, the present invention is also applicable to an image heating apparatus (device) which can be operated in three or more operational modes, which are different in recording medium conveyance speed (process speed).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 059711/2013 filed Mar. 22, 2013 which is hereby incorporated by reference.

What is claimed is:

1. An image heating apparatus comprising:

a rotatable heating member of magnetism-adjusted alloy configured to heat a toner image on a sheet;

an excitation coil configured to generate a magnetic flux for electromagnetic induction heating of said rotatable heating member;

a voltage source configured to supply an AC current to said excitation coil;

a rotating mechanism configured to rotate said rotatable heating member at a first peripheral speed in an operation in a first image heating mode and configured to rotate said rotatable heating member at a second peripheral speed lower than the first peripheral speed in an operation in a second image heating mode; and a controller configured to control said voltage source in which the maximum current supplied to said excitation coil in the second image heating mode is smaller than the maximum current supplied to said excitation coil in the first image heating mode.

2. An apparatus according to claim 1, wherein said controller controls said voltage source in which the frequency of the AC current supplied to said excitation coil in the second image heating mode is larger than the frequency of the AC current supplied to said excitation coil in the first image heating mode.

3. An apparatus according to claim 1, further comprising a temperature sensor configured to detect the temperature of said rotatable heating member, wherein said controller controls the current supplied to said excitation coil in accordance with the output of said temperature sensor so as to maintain a target temperature of said rotatable heating member.

4. An apparatus according to claim 1, wherein said rotatable heating member comprises a metal core of the magnetism-adjusted alloy and a toner parting layer provided on said metal core.

5. An image heating apparatus comprising:

an endless belt configured to heat a toner image on a sheet;

a roller of magnetism-adjusted alloy rotatably supporting said endless belt;

an excitation coil configured to generate a magnetic flux for electromagnetic induction heating of said roller;

a voltage source configured to supply an AC current to said excitation coil;

a rotating mechanism configured to rotate said roller at a first peripheral speed in an operation in a first image heating mode and configured to rotate said roller at a second peripheral speed lower than the first peripheral speed in an operation in a second image heating mode; and a controller configured to control said voltage source in which the maximum current supplied to said excitation coil in the second image heating mode is smaller than the maximum current supplied to said excitation coil in the first image heating mode.

6. An apparatus according to claim 5, wherein said controller controls said voltage source in which the frequency of the AC current supplied to said excitation coil in the second image heating mode is larger than the frequency of the AC current supplied to said excitation coil in the first image heating mode.

7. An image heating apparatus comprising:

an endless belt configured to heat a toner image on a sheet in a nip;

a rotatable member cooperative with said endless belt to form said nip;

an urging member provided inside said endless belt and configured to urge said endless belt toward said rotatable member;

an excitation coil configured to generate a magnetic flux for electromagnetic induction heating of said urging member;

a voltage source configured to supply an AC current to said excitation coil;

a rotating mechanism configured to rotate said endless belt at a first peripheral speed in an operation in a first image heating mode and configured to rotate said endless belt at a second peripheral speed lower than the first peripheral speed in a operation in a second image heating mode; and a controller configured to control said voltage source in which the maximum current supplied to said excitation coil in the second image heating mode is smaller than the maximum current supplied to said excitation coil in the first image heating mode.

8. An apparatus according to claim 7, wherein said controller controls said voltage source in which the frequency of the AC current supplied to said excitation coil in the second image heating mode is larger than the frequency of the AC current supplied to said excitation coil in the first image heating mode.

* * * * *